US006550205B2

(12) United States Patent
Neuhofer, Jr.

(10) Patent No.: US 6,550,205 B2
(45) Date of Patent: Apr. 22, 2003

(54) COVER APPARATUS FOR FLOORING SEAM GAPS OR THE LIKE

(76) Inventor: Franz Neuhofer, Jr., Haslau 56, A-4893 Zell am Moos (AT)

( * ) Notice: Subject to any disclaimer, the term of this patent is extended or adjusted under 35 U.S.C. 154(b) by 53 days.

(21) Appl. No.: 09/741,966

(22) Filed: Dec. 21, 2000

(65) Prior Publication Data

US 2001/0005539 A1 Jun. 28, 2001

(30) Foreign Application Priority Data

Dec. 22, 1999 (AT) ..... 889/99 U

(51) Int. Cl.[7] ..... B32B 3/06

(52) U.S. Cl. ..... 52/464; 52/465; 52/468; 16/7; 16/16; 428/61

(58) Field of Search ..... 428/61; 16/7, 16; 52/465, 468, 469, 459, 718.05, 718.06, 718.04, 463, 464, 466; 24/297, 292, 289; 299/93

(56) References Cited

U.S. PATENT DOCUMENTS 2,807,826 A * 10/1957 De Vault ..... 16/7
2,996,751 A * 8/1961 Roby et al. ..... 16/7
3,254,361 A * 6/1966 Brunn et al. ..... 16/16
3,308,598 A * 3/1967 Wilson ..... 24/289
4,837,889 A * 6/1989 Saotome ..... 16/16

FOREIGN PATENT DOCUMENTS

AT 000 862 6/1996
WO WO 93/12309 6/1993

* cited by examiner

*Primary Examiner*—Alexander S. Thomas
(74) *Attorney, Agent, or Firm*—Collard & Roe, P.C.

(57) ABSTRACT

A cover apparatus (1) for flooring seam gaps comprises a mounting profile (2) and a cover strip (3), with the mounting profile (2) which can be fastened to the base (U) by way of a bridge element (5) along the seam gaps (F) or the like comprising at least one leg element (6) which projects upwardly from the bridge element (5) and can be joined together in a clamping manner with the cover strip (3). In order to enable the perfect insertion of the cover apparatus even in the case of a curved progress of the seam gap, a cover strip (3) is provided which consists of a flectionally yielding material and can be bent about axes parallel to the direction of insertion, which cover strip is associated as a mounting profile (2) made of deflection-resistant material with a profile rail (4) which is subdivided by transversally extending indentations (8) into sections (9) which can be mutually swiveled about axes (A) which are parallel to the direction of insertion.

2 Claims, 1 Drawing Sheet

1
2
3
4
5
6
7
8
9
10
F
I
II
R
A
B
U

COVER APPARATUS FOR FLOORING SEAM GAPS OR THE LIKE

FIELD OF THE INVENTION

The invention relates to a cover apparatus for flooring seam gaps or the like with a mounting profile and cover strip, with the mounting profile which can be fastened on the base by way of a bridge element along the seam gaps or the like comprising at least one leg element which projects upwardly from the bridge element and can be plugged together in a clamping manner with the cover strip.

DESCRIPTION OF THE PRIOR ART

With the help of said cover apparatuses it is possible to bridge or cover expansion and boundary seam gaps or steps of floorings, as well as wall panelings and ceiling linings, with the mounting profiles forming clamping elements with their upwardly projecting leg elements and the cover strips being insertable in a clamping manner on the pre-mounted mounting profiles with their longitudinal grooves or longitudinal ribs which are adapted to said clamping elements with their arrangement and cross section, thus leading to an invisible possibility of fastening and the cover strips can be mounted and, if need be, dismounted without any special screwed or nailed-down connections. In order to achieve a sufficiently rigid clamping seat it is necessary that the mounting profiles consist of a respectively stiff material, which mounting profiles are also assigned up until now respectively deflection-resistant cover strips, so that with the known cover apparatuses it is only possible to cover seam gaps or steps extending in straight lines. Any curvatures must be replaced by covers which extend polygonally and require much effort in the laying.

SUMMARY OF THE INVENTION

The invention is therefore based on the object of providing a cover apparatus of the aforementioned kind which allows the rational covering of seam gaps that also extend in curves and still ensures a secure and stable fastening of the cover strips by means of the mounting profiles.

This object is achieved by the invention in that a cover strip is provided which consists of a flectionally yielding material and is flectional about the axes which extend parallel to the direction of insertion, which cover strip is associated with a plurality of individual profile elements or a profile rail, as a mounting profile made of a deflection-resistant material, which is subdivided in sections which can be swiveled about against each other about axes parallel to the direction of insertion by transversally extending indentations. The individual profile elements or the profile rails, which—if required—are subdivided into swivellable sections, can be fastened effortlessly to the base following the predetermined course, which may also be the curved progress of flooring seam gaps or steps, with the individual profile elements being laid mutually spaced in the direction of progress or tangentially to the progress of a curve, and the profile rails being laid along the effective length in the case of a straight progress or according to the curve in the case of a curved progress. As a result of the transversally extending indentations, which depending on the design of the profile are radial indentations along the outside curvature and/or suitable gusset-shaped indentations along the inside curvature, the profile rail can be pre-mounted with sufficient precision along the progress of the curve despite its manufacture of deflection-resistant material. The flectional cover strip can be pressed by simultaneous bending and clamping engagement according to the progress of the mounting profile on the profile elements or profile rail with a few manipulations by hand, thus ensuring a clean coverage of the gap or the like even along the progress of a curve. The indentations in the profile rail are appropriately performed only in the course of the laying by hand, for which purpose simple cutting tools such as garden scissors are sufficient. They could also be prepared by the manufacturer distributed over the entire rail length.

If the cover strip consists of a plasticized polyvinyl chloride (PVC), the cover strip comes with the desired flectionally yielding properties, with the material being provided with any desired dyeing capabilities and also offering the coating of the strip with any desired decorative foils or the like.

BRIEF DESCRIPTION OF THE DRAWING

The subject matter of the invention is schematically outlined the drawings, wherein.

DESCRIPTION OF THE PREFERRED EMBODIMENTS

Figures 1, 2:
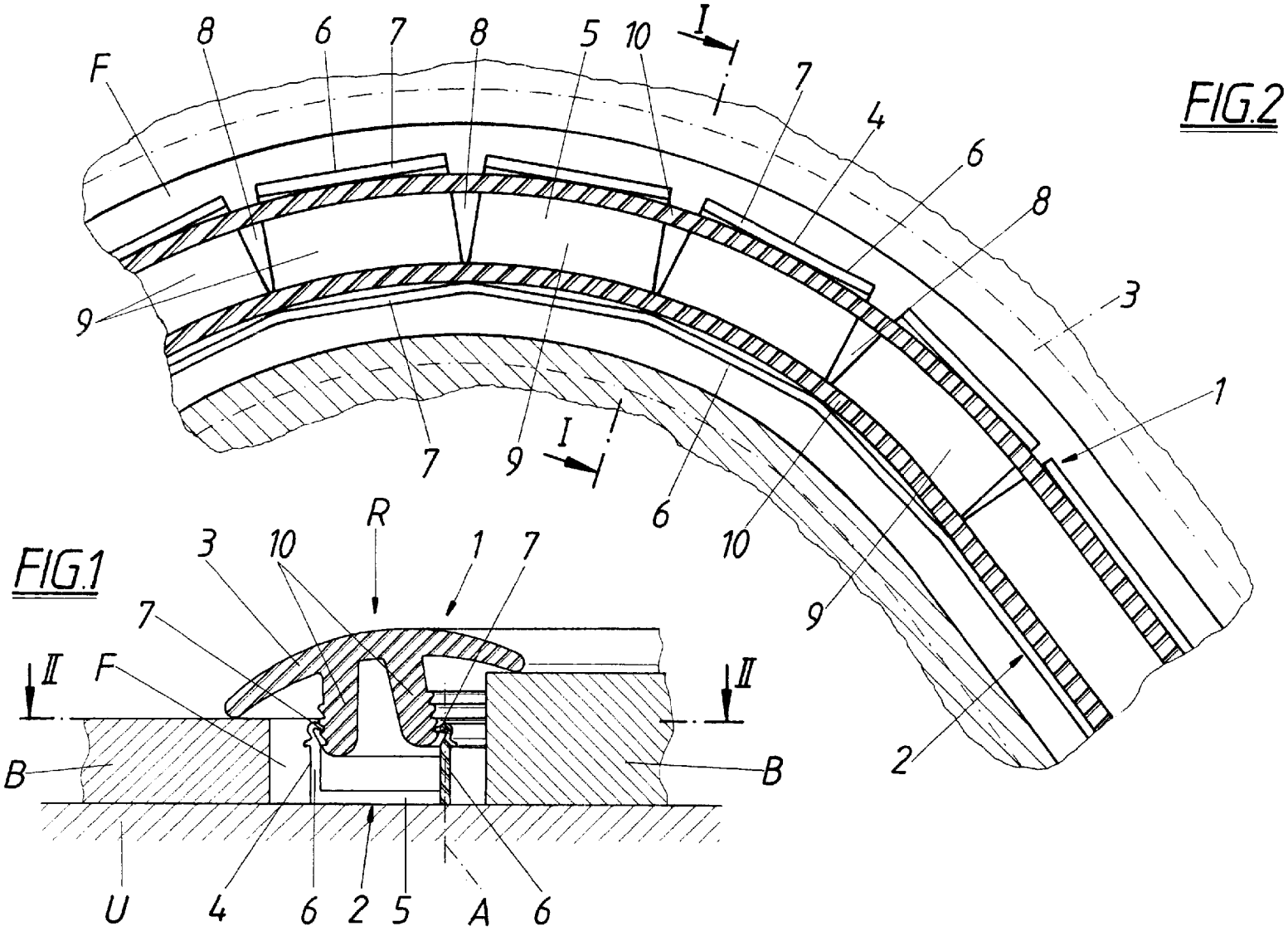
FIGS. 1 and 2 show a vertical sectional view along line I—I of FIG. 2 and a horizontal sectional view along line II—II of FIG. 1 of a flooring seam gap covered with a cover apparatus in accordance with the invention.

In order to enable the clean coverage of a curved transition gap F between two floorings B, a cover apparatus 1 with a mounting profile 2 and a cover strip 3 are provided. The mounting profile 2 consists of a profile rail 4 which can be fastened on the base U along a bridge part 5 of gap F and comprises two leg elements 6 with clamping elements 7 at the end portion which project upwardly from the bridge element 5. Said profile rail 4, which is made of a deflection-resistant material, is subdivided in the course of the laying by transversally extending indentations 8 into sections 9 which can be swiveled against one another about vertical axes A parallel to the base surface, so that it can also be adapted, like polygonal lines, to a curved progress of the gap F.

The cover strip 3 acting as a transition profile can be put together in a clamping manner with profile rail 4, for which purpose it forms projecting longitudinal ribs 10 on the bottom side which engage in a latching manner in the clamping elements 7 of the leg elements 6 of the profile rail 4. As is indicated in FIG. 2, the cover strip 3 can also be latched in an inclined manner with the profile rail 4 in order to compensate for any difference in height between the gap-limiting floorings B. The cover strip 3 consists of a flectionally yielding material and can be bent about axes which are parallel to the insertion direction, so that it can be bent during insertion on the profile rail 4 in a manner so as to follow the progress of the rail and ensures a proper coverage even of seam gaps F which extend in curves.

What is claimed is:

1. A cover apparatus for covering a gap between two floorings extending over a base, which comprises (a) mounting profile of a deflection-resistant material extending along the base of the gap and comprising
  (1) a bridge element fastenable to the base of the gap and
  (2) at least one leg element projecting upwardly from the bridge element, and (b) a cover strip of a flectionally yielding material, the cover strip being insertable into the mounting profile in a direction of insertion and joined therewith by clamping the cover strip to the at least one leg element, (1) the cover strip being bendable about axes extending parallel to the direction of insertion and (2) the mounting profile being comprised of a plurality of individual profile elements or a profile rail subdivided by transversely extending indentations into sections which may be swiveled about said axes relative to each other.

2. A cover apparatus as claimed in claim 1, wherein the cover strip consists of a plasticized polyvinyl chloride (PVC).

* * * * *